United States Patent [19]

Goedde et al.

[11] 4,423,404

[45] Dec. 27, 1983

[54] NON-LINEAR RESISTOR STACK AND ITS METHOD OF ASSEMBLY

[75] Inventors: Gary L. Goedde, Racine; Charles H. Rice, Franksville, both of Wis.

[73] Assignee: Electric Power Research Institute, Inc., Palo Alto, Calif.

[21] Appl. No.: 344,643

[22] Filed: Feb. 1, 1982

[51] Int. Cl.[3] ..... H01C 7/12

[52] U.S. Cl. ..... 338/21

[58] Field of Search ..... 338/21, 20, 309, 314; 29/610 R; 252/518, 519, 521; 361/127

[56] References Cited

U.S. PATENT DOCUMENTS

| | | | |
|---|---|---|---|
| 3,905,006 | 9/1975 | Matsuoka et al. | 338/21 |
| 3,959,543 | 5/1976 | Ellis | 338/21 X |
| 4,031,498 | 6/1977 | Hayashi et al. | 338/21 |
| 4,148,135 | 4/1979 | Sakahaug et al. | 338/21 X |
| 4,319,215 | 3/1982 | Yamazaki et al. | 338/21 |

FOREIGN PATENT DOCUMENTS

| | | | |
|---|---|---|---|
| 54-28595 | 9/1979 | Japan | 338/21 |
| 764693 | 1/1957 | United Kingdom | 338/21 |

*Primary Examiner*—C. L. Albritton

*Attorney, Agent, or Firm*—Flehr, Hohbach, Test, Albritton & Herbert

[57] ABSTRACT

Non-linear resistors especially suitable for assembling into a stack are disclosed herein along with the stack and its method of assembly. Each resistor has opposite end surfaces to which a certain electrically conductive bonding substance, specifically solder, will adhere and an outer circumferential side surface extending between the end surfaces. The entire side surface of each wafer is covered with a coating layer formed from a dielectric composition to which the specific bonding substance will not adhere. This composition is also one which is able to withstand coming into contact with the bonding substance when the latter is in a liquid state, that is, it is able to withstand the temperature of molten solder when solder is used as the bonding substance and it must also be able to withstand the expected voltage and current levels across the wafer without any adverse effects. These coated wafers are bonded together in an end-to-end relationship with one another so as to form a stack using the solder or other such specific bonding substance.

3 Claims, 3 Drawing Figures

NON-LINEAR RESISTOR STACK AND ITS METHOD OF ASSEMBLY

Figure 1:
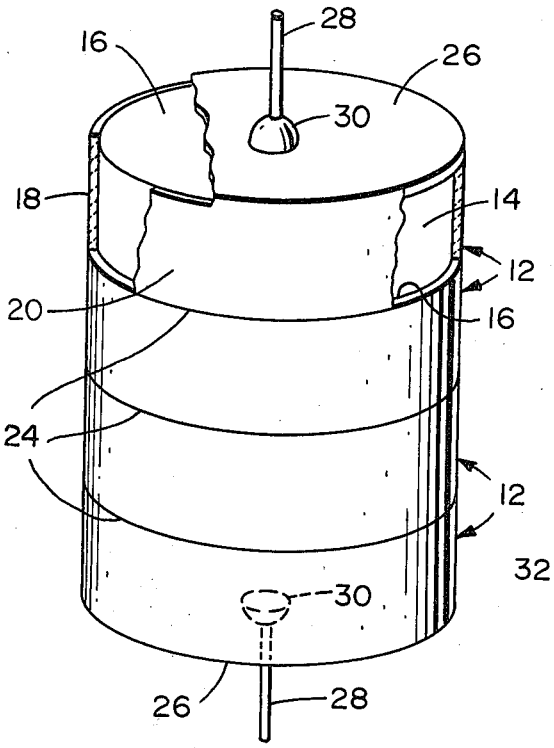

The present invention relates generally to non-linear resistors and more particularly to a stack of these resistors and a specific method of assembling the stack. Voltage dependent non-linear resistors or varistors as they are commonly called are well known in the art. See for example U.S. Pat. No. 3,764,566 which describes one composed primarily of zinc oxide. Varistors of this type can be operated individually or in stacks. In this latter case, the adjacent ends of adjacent varistors are bonded together using an electrically conductive bonding substance such as solder. In carrying out this assembly procedure, it is important to make sure that the end product, that is, the bonded stack does not include any bonding substance on the side surface of any individual varistor since this might short out that particular varistor.

In view of the foregoing, a general object of the present invention is to provide a voltage dependent varistor which is especially suitable for use in a stack and which is designed in an uncomplicated and reliable way to ensure that its side surface is "clean," that is, free of bonding substances, after the varistor is made part of the stack.

A more specific object of the present invention is to ensure that the side surface of each varistor in the stack just recited is clean while the means for accomplishing this also minimizes the possibility of flashover between the ends of the varistor during operation thereof.

As will be seen hereinafter, the non-linear resistor or varistor disclosed herein is one which is comprised of a voltage dependent, non-linear resistance wafer having opposite ends to which specific electrically conductive bonding substance, for example, solder, will adhere and an outer circumferential side surface extending between the end surfaces. An outer coating layer is utilized to cover the entire side surface of the wafer. This coating layer is formed from a dielectric composition to which the solder or like bonding substance will not adhere. At the same time, the composition must be one which is able to withstand the maximum expected voltage and current levels of the wafer without any adverse effects. It also must be able to withstand coming into contact with the specific bonding substance used when the latter is in its initial state which means that it must be able to withstand the relatively high temperatures of molten solder when this particular material is used.

A plurality of individual voltage dependent, varistors of the type just recited are fixedly assembled together in end-to-end relationship with one another by means of solder or other such suitable electrically conductive bonding substance. The outer coating layer around each wafer not only serves as an anti-flashover collar (because of its dielectric properties) but also as a means for ensuring that the end product does not include bonding substance on any of its side surfaces, even though the entire stack of varistors may be entirely submerged in a bath of the bonding substance as part of the overall assembly process.

Figure 2:
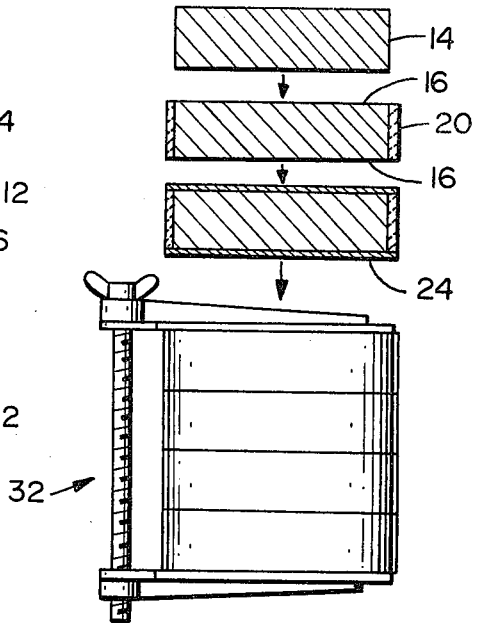
Figure 3:
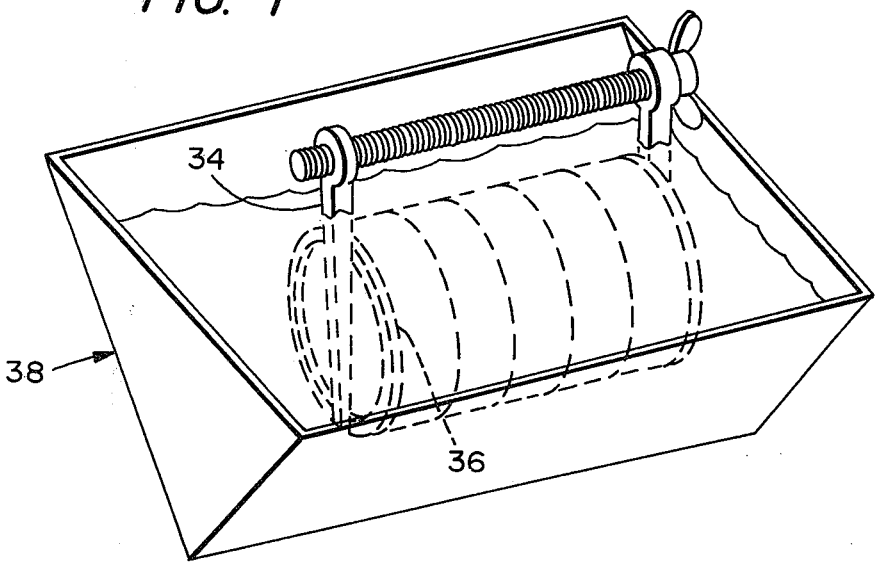

The individual varistors and a preferred way of assembling them together into a stack will be described in more detail hereinafter in conjunction with the drawings, wherein:

FIG. 1 is a perspective view of the stack itself;

FIG. 2 diagrammatically illustrates how the stack shown in FIG. 1 is assembled from individual varistors; and FIG. 3 is a perspective view illustrating a particular step in the process of FIG. 2.

Turning now to the drawings, attention is first directed to FIG. 1 which shows an assembled stack 10 of voltage dependent non-linear resistors or varistors 12. These varistors, per se, are well known in the art and therefore will not be described in detail. It suffices to say that each includes a varistor body 14, that is, a voltage dependent, non-linear resistance wafer, which has opposite end surfaces 16 and an outer circumferential side surface 18 extending between the end surfaces. The entire side surface 18 is covered by a coating layer or sleeve 20 which serves several purposes in accordance with the present invention as will be discussed hereinafter.

The varistor body itself may be formed from a suitable, known composition, for example, one of the zinc oxide compositions described in U.S. Pat. No. 3,764,566 in accordance with any known process. As illustrated in FIG. 1, the individual varistors 12 are placed in end-to-end relationship with one another in order to form stack 12. These varistors are fixedly maintained in this stacked arrangement by suitable electrically conductive bonding substance in the form of layers 24 between adjacent ends of adjacent varistor bodies. Obviously, the bonding substance must be of a type which adheres directly to the varistor body itself. In a preferred embodiment this bonding substance is solder and will be described hereinafter as such, although it is to be understood that the present invention is not limited to this particular bonding substance.

Overall stack 10 not only includes layers 24 of solder between the adjacent ends of adjacent varistor bodies, but also at the extreme ends of the stack, as indicated at 26 although, metal plates have been and could be used in place of these end layers. These end layers (or metal plates) serve as opposite electrodes. To this end, each includes an appropriate lead wire 28 and means 30 for electrically connecting the lead wire to an associated layer 26. In this way, the entire stack can be electrically connected into operation as if it were a single varistor. The intermediate layers of solder 24 electrically connect the individual varistor bodies 14 to one another, thereby allowing the entire stack to function as a single entity.

As stated above, coating layer or sleeve 20 is intended to serve several purposes. First, it is to serve as an anti-flashover collar in the conventional way and, hence, must be formed from a dielectric composition which is able to withstand the maximum expected voltage level across each varistor body during operation of the overall stack. These operating levels may be as high as 5000 volts/centimeter of varistor material. Second, as will be seen hereinafter, each coating layer or sleeve serves to prevent solder from adhering to the side surface of its associated varistor body and therefore to the overall circumferential side surface of stack 10 even though the entire stack may be completely submerged in molten solder during assembly. Should the ultimately formed stack 10 include solder on the side surface of one of its varistors, this solder could function as a short across that particular varistor, thereby effectively eliminating it from the stack. On the other hand, it is quite desirable to manufacture the stack in the particular way to be described hereinafter which, as will be seen, is relatively uncomplicated, reliable and economical to carry out, although it requires submerging the stack in molten solder. In order to practice this process and, at the same time, prevent the solder from adhering to the side of the stack, the composition making up each coating layer or sleeve 20 must not only be dielectric but must also be a substance to which solder does not adhere. At the same time, it must be able to withstand the temperature of molten solder, as will become apparent.

One particular substance which meets all of the foregoing requirements for use as coating layer 20 is a lead bearing glass frit substance and specifically Ferro No. 3419 manufactured by Ferro Corporation, Cleveland, Ohio. This particular material is composed of the following ingredients by approximate dry weight percent:

lead oxide . . . 59.2%
silicone dioxide . . . 19.9%
boron oxide . . . 14.5%
sodium oxide . . . 6.4%

The material just recited has a fusion temperature of around 540° C. with a coefficient of thermal expansion of $8.2\times\times10^{-6}$ cm/cm °C. It is a dielectric capable of withstanding the maximum expected voltage and current levels of each varistor body 14 during operation of the overall stack 10. Moreover, it is able to withstand the relatively high temperatures of molten solder (e.g. between 500° and 600° C.) and it is a substance to which solder does not adhere.

Referring to FIG. 2, attention is now directed to a specific method of assembling stack 10. The starting components are the varistor bodies 14 which have been formed in accordance with a known process. The entire circumferential side surface 18 of each is provided with layer or sleeve 20. If sleeve 20 is composed of the previously recited lead bearing glass frit, the latter is preferably initially applied to the circumferential side surface of each varistor body by means of an air brush. The coated body is thereafter heated to the fusion temperature of the glass material for a prescribed period of time, specifically one hour, and then slowly cooled to room temperature. A single layer can be provided in this way or multiple layers could be provided if desired by repeating this step. Once the glass layer has been provided and cured, it is ready to serve as an anti-flashover collar and, at the same time, prevents solder from adhering to the side of its associated varistor body.

Thereafter, the ends 16 of each varistor body (except possibly the outer ends of the endmost varistors) are next dipped into a pool of molten solder so as to be coated thereby. After this has been done, all of the varistor bodies are stacked in end-to-end relationship with one another, as shown in FIG. 2, and mechanically maintained in this stacked configuration by suitable means such as the clamping device 32 illustrated. Any type of clamping device may be provided so long as it does not interfere with the formation of solder layers 24 and 26, particularly layers 26. In this latter regard, device 32 is shown including clamping jaws 34, each of which has a ring-shaped member 36 (see FIG. 3) which is configured to engage only a corresponding outer circular section of an associated end of the stack. In this way, the jaws do not interfere with the formation of outermost solder layers 26. For the reasons to become apparent hereinafter, the clamping jaws themselves are constructed of a material, for example, steel covered with some suitable form of mold release material or antibond coating for preventing the jaws from bonding to the solder or metal and layers of the stack.

Once the end coated varistor bodies having associated coating layers or sleeves 20 are clamped together in the manner shown in the FIG. 2, the clamped stack is submerged in a bath of solder generally indicated at 38 in FIG. 3. In this way, all of the interstices between adjacent ends of adjacent varistor bodies are coated with molten solder, thereby assuring complete layers 24. At the same time, the outermost ends of the stack are again coated or coated for the first time if the ends were initially left uncoated (which may be desirable in order to be able to readily handle the stack in conjunction with the clamping devices). In any event, once the entire clamp stack has been submerged in the reservoir of solder it is removed and the solder remaining thereon is allowed to solidify. Because of layers 20 the overall circumferential side surface of the stack is free of solder (except of course at the joints between adjacent varistor bodies). Once the solder has solidified the clamping device may be removed therefrom, and the lead wires 28 can be readily connected to end layers 26 using means 30.

Overall stack 10 has been described including coating layers 20 and bonding layers 24,26 of specific types, that is, a lead bearing glass frit in the case of the coating layers and solder in the case of the bonding layers. It is to be understood however that the overall stack is not limited to these specific substances so long as those selected meet the criteria described previously. More specifically, the coating layers 20 must be capable of serving as anti-flashover collars and means for preventing the bonding substance selected from adhering to the overall side surface of the ultimately formed stack. At the same time, if the bonding substance is initially applied hot, as in the case of solder, the coating layers 20 must be capable of withstanding the temperature of the bonding substance without adverse affects. The bonding substance itself must of course be one which will adhere to the varistor body directly and, of course, it must be an electrically conductive material.

What is claimed is:

1. A non-linear resistor assembly, comprising: a plurality of individual voltage dependent, non-linear resistance wafers, each of which has opposite end surfaces to which solder will adhere and an outer circumferential side surface extending between the end surfaces; said wafers being stacked in end-to-end relationship with one another; an outer coating layer covering the entire side surface of each of said wafers, each of said coating layers being formed from a dielectric composition to which soldering substance does not adhere, said composition being able to withstand the temperature of molten solder and the maximum expected voltage level across each wafer without any adverse effects; and hardened soldering substance between the adjacent ends of adjacent wafers for bonding the adjacent wafers together, said coating layer being a lead glass frit composition consisting essentially of the following, by approximate dry weight percent:

lead oxide . . . 59.2%
silicone dioxide . . . 19.9%
boron oxide . . . 14.5%
sodium oxide . . . 6.4%.

2. A method of assembling a stack of individual voltage dependent, non-linear resistance wafers, each of which has opposite end surfaces to which solder will adhere and an outer circumferential side surface extending between the end surfaces, said method comprising the steps of: covering the entire side surface of each of said wafers with a coating layer formed from a dielectric composition to which soldering substance will not adhere, said composition also being one which is able to withstand the temperature of molten solder and the maximum expected voltage level of each wafer without any adverse effects; and solder connecting said wafers in end-to-end relationship with one another by coating the adjacent ends of adjacent ones of said wafers with molten solder before the wafers are placed in end-to-end relationship with one another and thereafter maintaining said wafers in end-to-end relationship, by mechanical means and submerging said mechanically maintained stack of wafers in a bath of molten solder.

3. A method according to claim 2 wherein said dielectric composition is a lead bearing glass frit.

* * * * *